United States Patent [19]

Wright

[11] Patent Number: 4,674,973

[45] Date of Patent: Jun. 23, 1987

[54] GAS BURNERS

[75] Inventor: Peter Wright, Sutton Coldfield, England

[73] Assignee: Valor Heating Limited, England

[21] Appl. No.: 834,319

[22] Filed: Feb. 26, 1986

[51] Int. Cl.[4] ..... F23Q 9/00

[52] U.S. Cl. ..... 431/284; 431/354; 431/328; 126/39 J

[58] Field of Search ..... 431/354, 284, 328; 126/39 J; 48/180 F

[56] References Cited

U.S. PATENT DOCUMENTS

| | | | |
|---|---|---|---|
| 1,346,935 | 7/1920 | Brigel | 431/354 |
| 2,549,952 | 4/1951 | Wheelock | 431/284 X |
| 2,935,128 | 5/1960 | Ferguson | 431/284 |
| 3,077,922 | 2/1963 | Soucie | 431/284 X |
| 3,606,612 | 9/1971 | Reid, Jr. | 431/284 X |
| 4,418,456 | 12/1983 | Riehl | 431/354 X |

*Primary Examiner*—Randall L. Green

*Attorney, Agent, or Firm*—Andrus, Sceales, Starke & Sawall

[57] ABSTRACT

A burner comprising a primary mixing chamber having one or more gas inlets and one or more primary air inlets; and one or more secondary mixing chambers, a perforated portion being provided in a side wall of each of said secondary mixing chambers, and each of said secondary mixing chambers communicating with the primary mixing chamber; each primary air inlet 6 comprising an aperture in a wall of the primary mixing chamber and a sliding member attached to the primary mixing chamber over the aperture and movable between a first limit position when the aperture is completely covered by the member and a second limit position when the aperture is completely uncovered by the member, means being provided to retain the member at any position intermediate the first and second limit positions.

1 Claim, 3 Drawing Figures

GAS BURNERS

Figure 1:
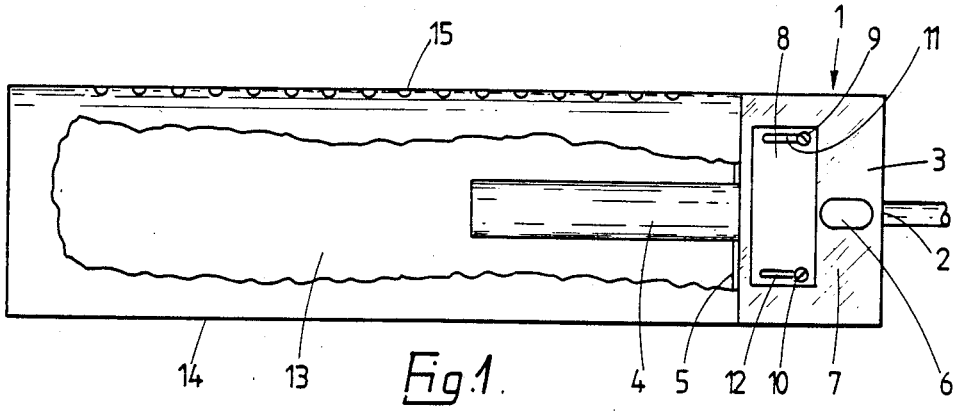

The present application relates to gas burners, in particular, gas burners for use in gas fires.

A typical, conventional-type burner for use in gas fires comprises a primary air box having one or more gas inlets, one or more primary air inlets, and one or more mixing tubes. Each mixing tube leads to a respective mixing chamber which has a perforated portion in a wall of the chamber at which combustion takes place. The injection of gas through the gas inlet into the primary air box causes primary air to be drawn in through the primary air inlets and the gas and air passes into the mixing chamber through the mixing tube forming a gas/air mixture which may be ignited at the perforated portion of the mixing chamber. Provided that the gas/air mixture is within the flammability limits and continuous, when the mixture is ignited a flame will burn on the surface of the burner and secondary air is entrained to complete combustion. The design of such burners usually balances the primary and secondary aeration, so that a completely combusting flame is produced with a blue keen primary flame and an almost invisible secondary flame. However, certain types of gas fires use artificial fuel beds, i.e. simulated logs or coals etc which are non-flammable, in order to produce the visual effect of a log fire or a coal fire whilst retaining the simplicity and cleanliness of a gas fire. In order to complete the visual effect, it is necessary to produce a yellow incandescent flame at the fuel bed rather than the conventional blue flame.

It is an object of the present invention to provide a burner for a gas fire which will produce a yellow incandescent flame, which may be used in a gas fire using any of the normal fuel gas supplies. In order to produce the yellow incandescent flame, it is necessary to restrict the amount of primary air entering the burner so that incomplete combustion takes place at the perforated portion of the burner. However, different types of gases require different degrees of restriction of the amount of primary air entering the burner in order to produce the desired effect. In order for a burner to be useful with a variety of gases, it will be necessary to be able to adjust the amount of primary air entering the burner.

In accordance with the present invention, there is provided a burner comprising a primary mixing chamber having one or more gas inlets and one or more primary air inlets; and one or more secondary mixing chambers, a perforated portion being provided in a side wall of each of said secondary mixing chambers, and each of said secondary mixing chamber communicating with the primary mixing chambers; each primary air inlet comprising an aperture in a wall of the primary mixing chamber and a sliding member attached to the primary mixing chamber over the aperture and movable between a first limit position when the aperture is completely covered by the member and a second limit position when the aperture is completely uncovered by the member, means being provided to retain the member at any position intermediate the first and second limit positions.

It is preferred that the sliding member is a sliding plate.

It is also preferred that one or more friction screws is used as the means to retain the member.

In a particularly preferred embodiment of the present invention, each secondary mixing chamber is connected to the primary mixing chamber by means of a respective tube so that the gas/air mixture supply to each secondary mixing chamber is discrete from the supply to any other secondary chamber.

A gas burner according to the present invention may be formed by a single burner having one or more mixing chambers or alternatively a plurality of single mixing chamber burners combined to form one unit.

Figure 2:
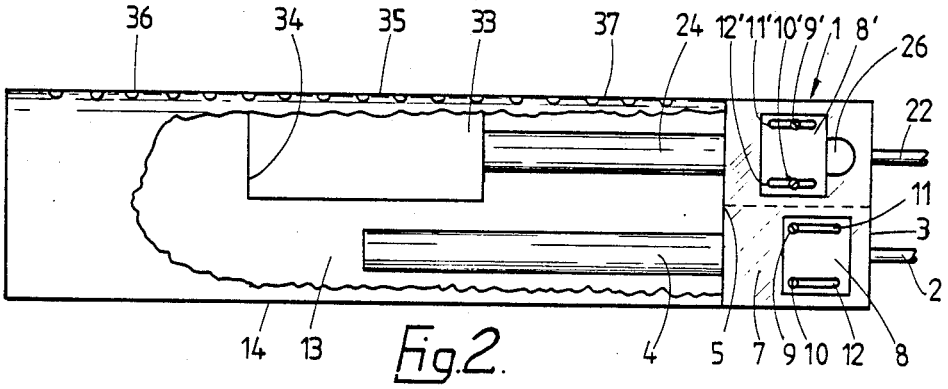
Figure 3:
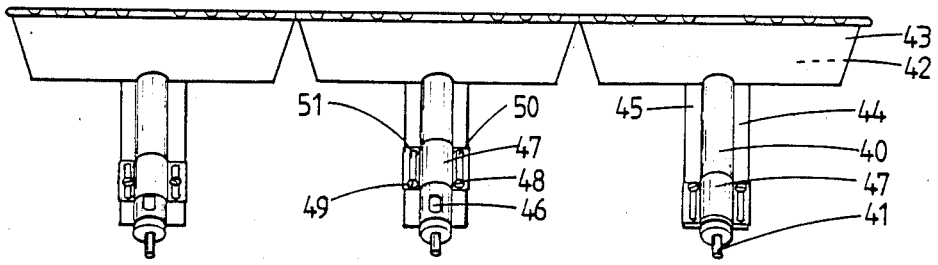

In the accompanying drawings,

FIG. 1 is a part cut-away elevation of an embodiment of a burner having a single secondary mixing chamber according to the present invention, FIG. 2 is a part cut-away elevation of an embodiment of a burner having two secondary mixing chambers, and FIG. 3 is a burner unit comprising three single secondary mixing chamber burners of a further embodiment of the present invention.

Referring now to FIG. 1 the burner according to the present invention comprises a primary mixing chamber 1 having a gas inlet 2 provided in an end wall 3 thereof and a tube 4 diametrically opposite the gas inlet 2 attached to an opposite end wall 5 of the primary mixing chamber 1. A primary air inlet 6 is provided in a side wall 7 of the primary mixing chamber 1, the primary air inlet 6 being level with both the gas inlet 2 and the mixing tube 4. An adjustable shutter plate 8 is provided on the outside of the side wall 7. The shutter plate 8 is attached to the side wall 7 by means of friction screws 9 and 10, which pass through respective slots 11 and 12 provided in the end portions of the shutter plate 8 and engage the side wall 7. The length of the slots 11 and 12 determines the range of movement possible for the shutter plate 8. The tube 4 extends away from the primary mixing chamber 1 into a secondary mixing chamber 13 defined by the walls of a mixing box 14. A perforated strip 15 is provided in one wall of the box 14, the perforated strip 15 running parallel to the long axis of the mixing box 14.

In FIG. 2 reference numerals 1 to 15 are used to indicate those parts of the burner which have already been described in relation to FIG. 1 using the same numerals. However, the embodiments shown in FIG. 2 also comprises a further gas inlet 22 located in the end wall 3, a further tube 24 located in the opposite end wall 5 and a further primary air inlet 26 located in the side wall 7 along side the primary air inlet 6 and also having an adjustable shutter plate 8' attached to the side wall 7 by means of friction screws 9' and 10' passing through slots 11' and 12'. Located within the secondary mixing chamber 13 and attached to the inner wall of the box 14 at a central portion 35 of the perforated strip 15 is a further mixing chamber 33 defined by a second mixing box 34. The further mixing chamber 33 is connected to the primary mixing chamber by means of the further tube 24 so that the gas/air mixture provided to the further mixing chamber 33 is separate from the gas/air mixture provided to the secondary mixing chamber 13.

Referring again to FIG. 1, in use gas is injected into the primary mixing chamber 1 via the gas inlet 2, and the passage of gas through the primary mixing chamber 1 draws in air through the primary air inlet 6. The gas and air pass through the tube 4 into the secondary mixing chamber 13 where the gas/air mixture forms and passes through the perforations in the perforated strip 15 where it may be ignited. The amount of air entering the primary mixing chamber 1 through the primary air inlet 6 is dependent upon the size of the primary air inlet 6. The size of the primary air inlet 6 may be adjusted by releasing the friction screws 9 and 10 and sliding the shutter plate 8 until it covers part of the primary air inlet 6 and so reduces its effective size. The position of the shutter plate may be adjusted within the limits defined by the slots 11 and 12 until the desired quality of flame is produced at the perforated strip 15, at which point the friction screws 9 and 10 may be tightened to maintain the shutter plate 8 in the required position over the primary air inlet 6. A similar method of adjustment may be used for the burner shown in FIG. 2 but in this embodiment it will be necessary to adjust the size of both the primary air inlet 6 and the further primary air inlet 26 as the flame produced at the perforated strip and region 35 is independent of the gas/air supply to the mixing chamber 13. It will be appreciated that there are three distinct regions 35, 36 and 37 in which a flame can be produced from the perforated strip 15. The regions 36 and 37 are controlled by the gas inlet 2, the primary air inlet 6 and the position of the shutter plate 8. The quality of flame produced in the region 35 will be effected by the further gas inlet 22 and the position of the further shutter plate 8'. Therefore, it is possible to have a different type of flame produced at the region 35 compared to that produced at the regions 36 and 37.

The multiple burner unit shown in FIG. 3 comprises a burner arrangement of three identical burners. Each burner comprises a tubular primary mixing chamber 40 having a gas inlet 41 at one end and opening into a secondary mixing chamber 42 defined by a box 43 at its other end. Two radially extending flanges 44 and 45 are provided on diametrically opposite sides of the tube 40, each of said flanges 44 and 45 being parallel to the longitudinal axis of the tube 40. A primary air inlet 46 is provided in the wall of the tube 40 near the gas inlet 41. An adjustable shutter 47 is configurated so that it fits over the tube 40 and is attached to the flanges 44 and 45 by means of a pair of friction screws 48 and 49 which pass through respective slots 50 and 51.

Each burner operates in the same way as the single burner described in relation to FIG. 1 above and the flame at each burner may be adjusted independently of the other burners.

I claim:

1. A gas burner for providing a desired visual yellow flame color for an open log or coal fire or the like and with said burner being adaptable for use with different types of gases, said burner comprising:

(a) a multi-walled housing forming a plurality of divided primary mixing chambers, (b) a separate gas inlet communicating with each of said primary mixing chambers, respectively through an end wall of said housing, (c) a separate adjustable air inlet communicating with each of said primary mixing chambers, respectively through a side wall of said housing, (d) a hollow body connected to and extending longitudinally outwardly from the other end wall of said housing and with said hollow body forming a first secondary mixing chamber, (e) a longitudinally extending perforated gas discharge strip disposed on said hollow body and in flow communication therewith, (f) a first tube communicating with one of said primary mixing chambers and extending longitudinally from said other end wall of said housing into said first secondary mixing chamber, (g) a second tube communicating with another of said primary mixing chambers and extending longitudinally from said other end wall of said housing into said first secondary mixing chamber for providing an air-gas mixture thereinto, and with said second tube being generally parallel to said first tube, (h) and a further body disposed within said first secondary mixing chamber and attached to said hollow body longitudinally centrally of said gas discharge strip, said further body forming a second secondary mixing chamber disposed within said first secondary mixing chamber and in communication with said gas discharge strip and further disposed adjacent the terminus of said first tube and in communication therewith.

* * * * *